United States Patent [19]

Stackhouse

[11] 3,948,068

[45] Apr. 6, 1976

[54] MAGNETIC LOCK

[75] Inventor: Wells F. Stackhouse, Ashville, N.Y.

[73] Assignee: American Locker Company, Inc., Jamestown, N.Y.

[22] Filed: May 14, 1975

[21] Appl. No.: 577,449

[52] U.S. Cl. ..... 70/276; 70/366; 70/382

[51] Int. Cl.[2] ..... E05B 47/00

[58] Field of Search ..... 70/276

[56] References Cited

UNITED STATES PATENTS

| | | | |
|---|---|---|---|
| 428,247 | 5/1890 | Fenner | 70/276 |
| 3,056,276 | 10/1962 | Allander | 70/276 |
| 3,657,907 | 4/1972 | Boving | 70/38 C |
| 3,857,262 | 12/1974 | Sidiropoulos | 70/276 |

*Primary Examiner*—Albert G. Craig, Jr.
*Attorney, Agent, or Firm*—Bean & Bean

[57] ABSTRACT

In a magnetic lock of the type having at least one tumbler pin pivotally supported on a mounting plate and a locking plate having an opening arranged to receive one end of the tumbler pin when an opposite end of such pin is attracted by a permanent magnet device carried by a key, the improvement wherein the opposite end of the tumbler pin is formed with a transversely enlarged head portion and the mounting plate is formed with abutment devices arranged to engage with the head portion to insure that the one end of the tumbler pin accurately "points" towards the opening of the locking plate.

30 Claims, 18 Drawing Figures

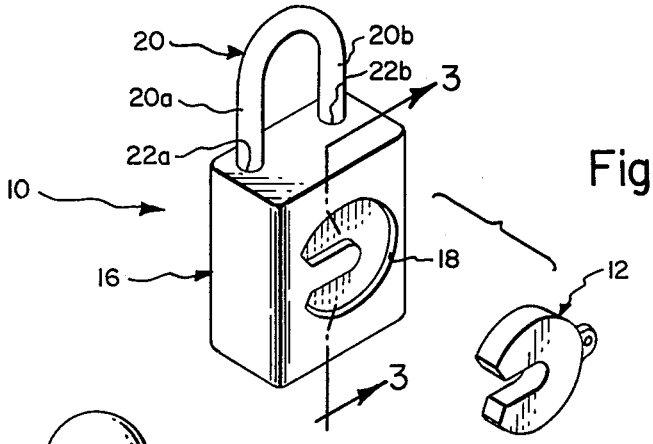
Fig. 1.
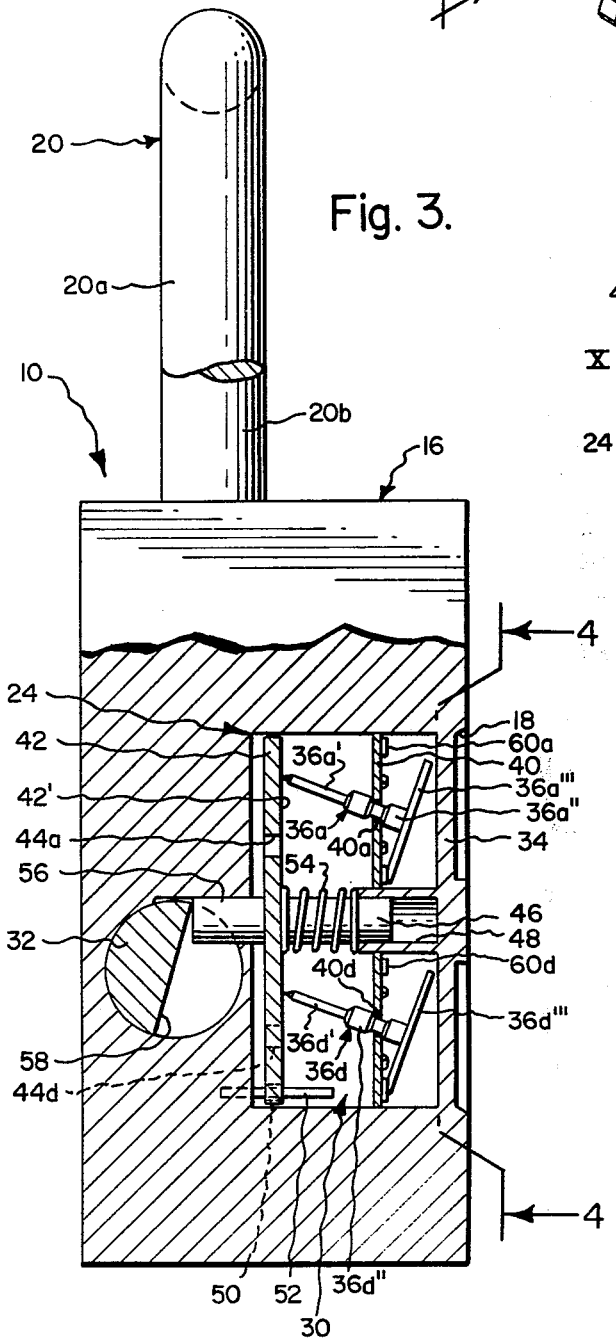
Fig. 3.
Fig. 4.
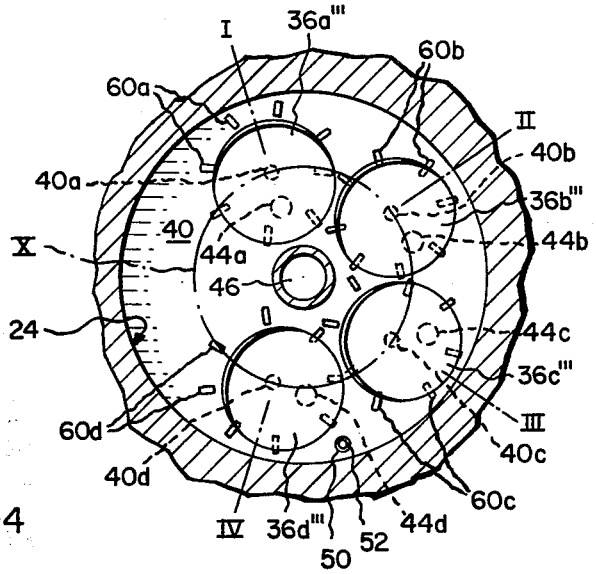
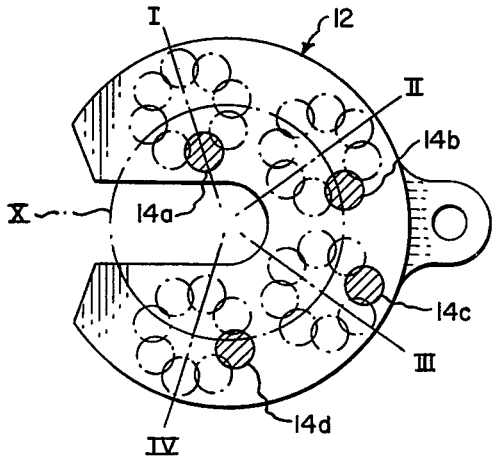
Fig. 2.

Fig. 5.
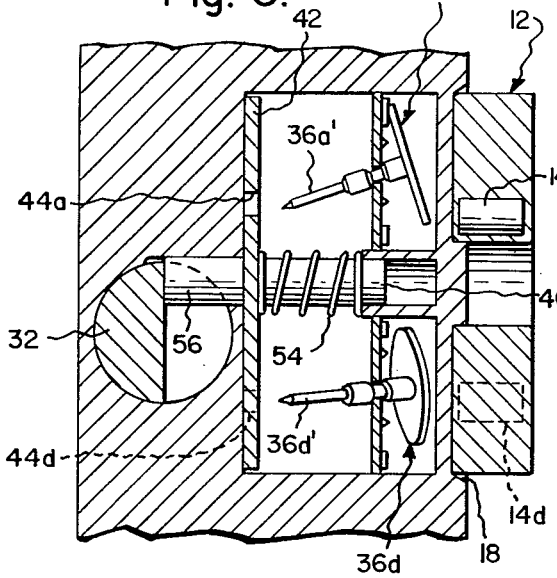
Fig. 6.
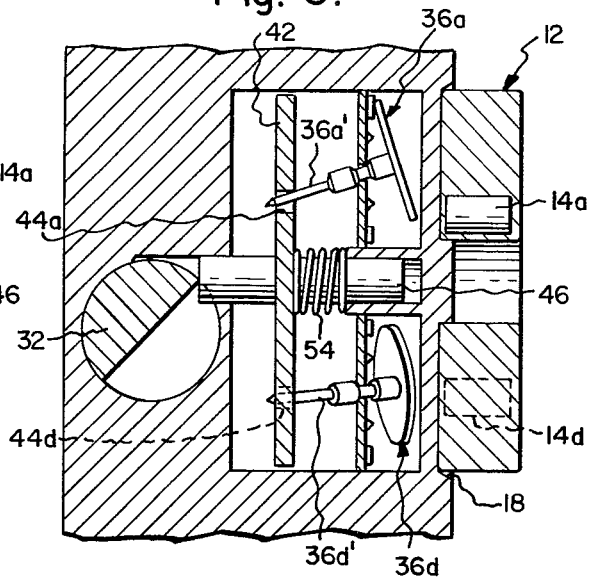
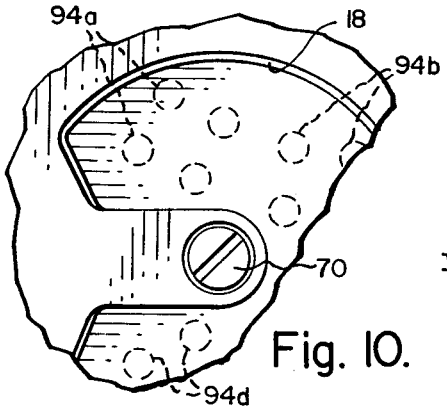
Fig. 10.
Fig. 9.
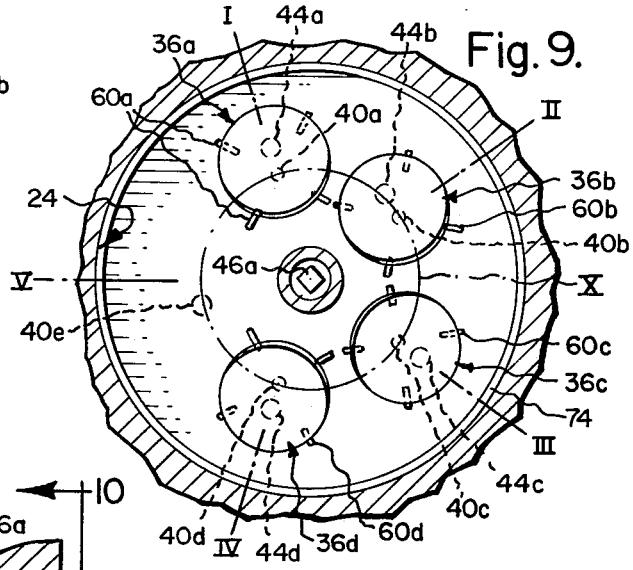
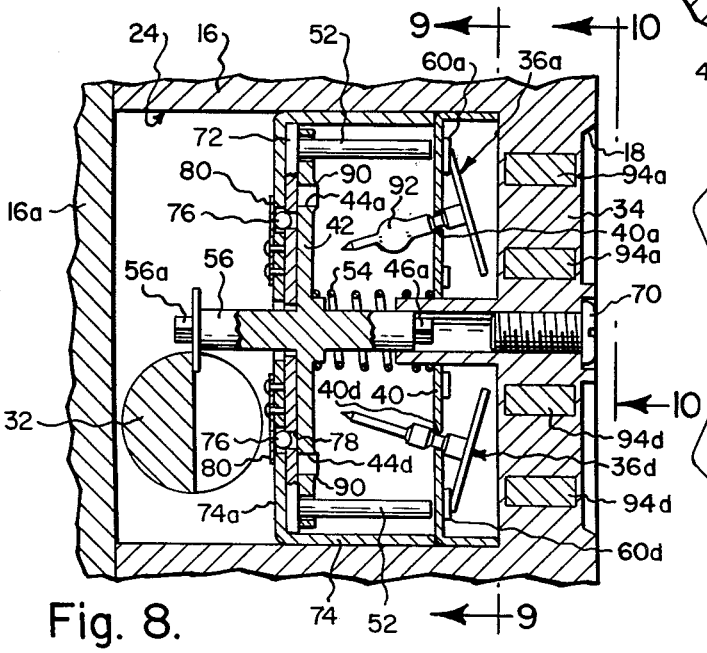
Fig. 8.
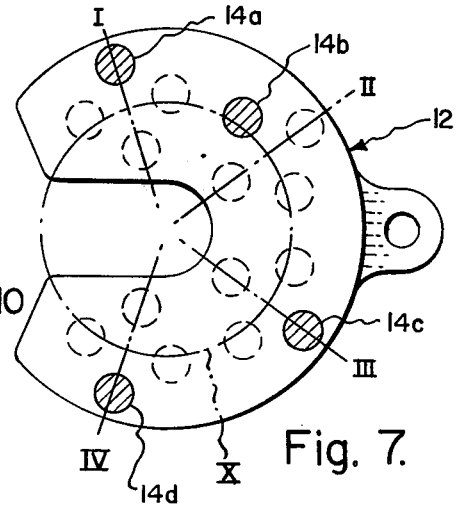
Fig. 7.

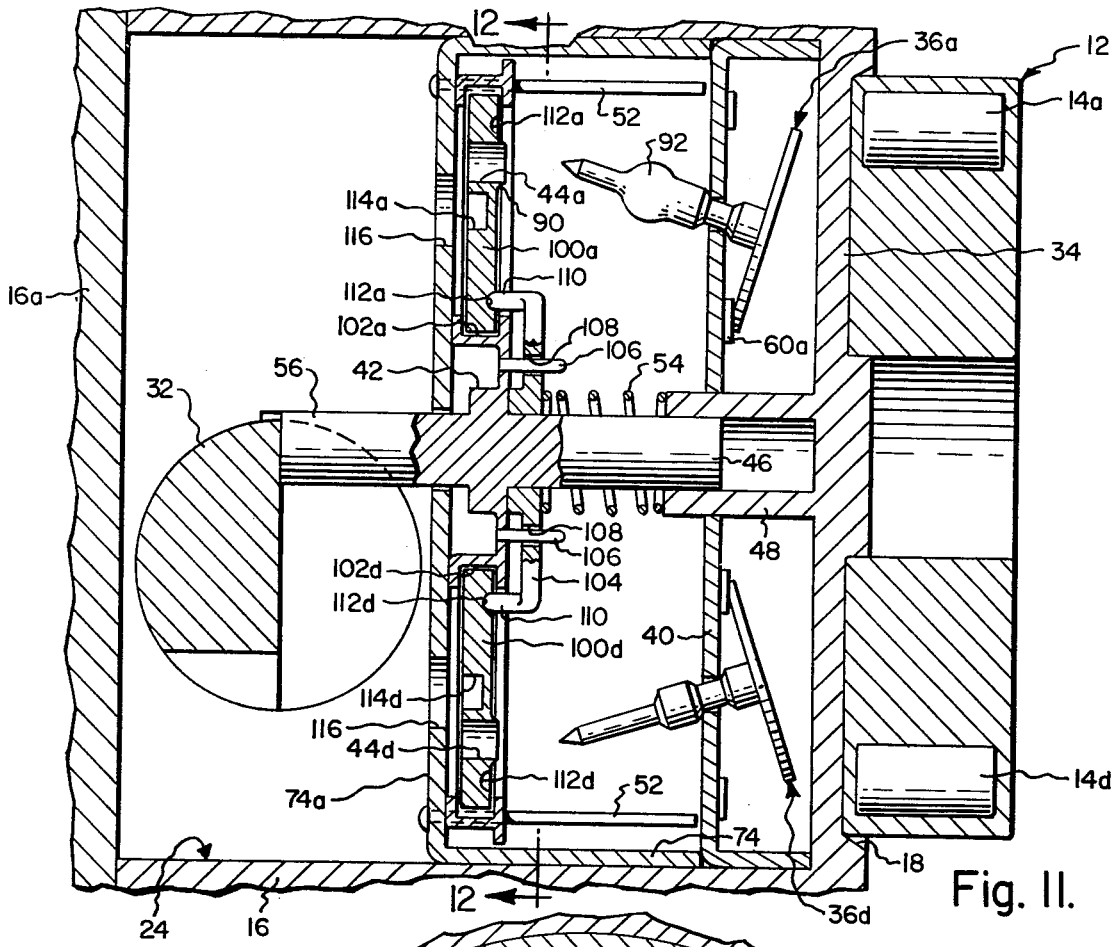
Fig. 11.
Fig. 12.
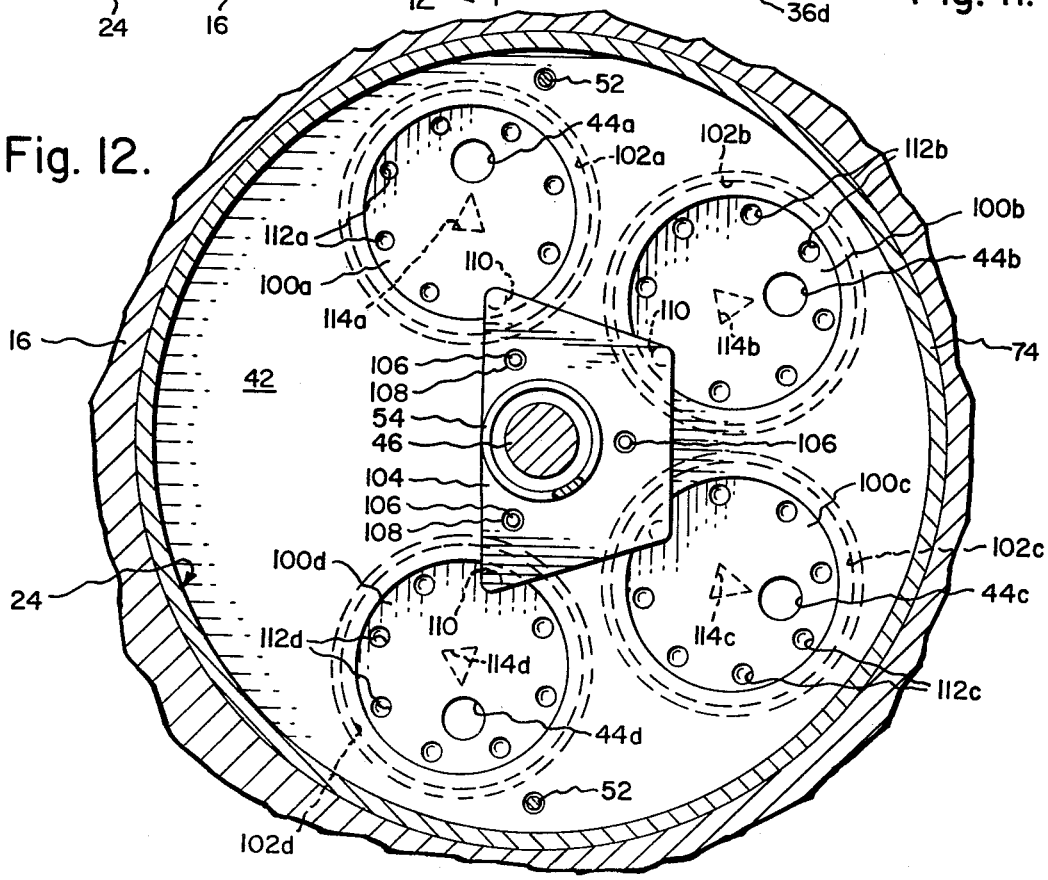

Fig. 13.
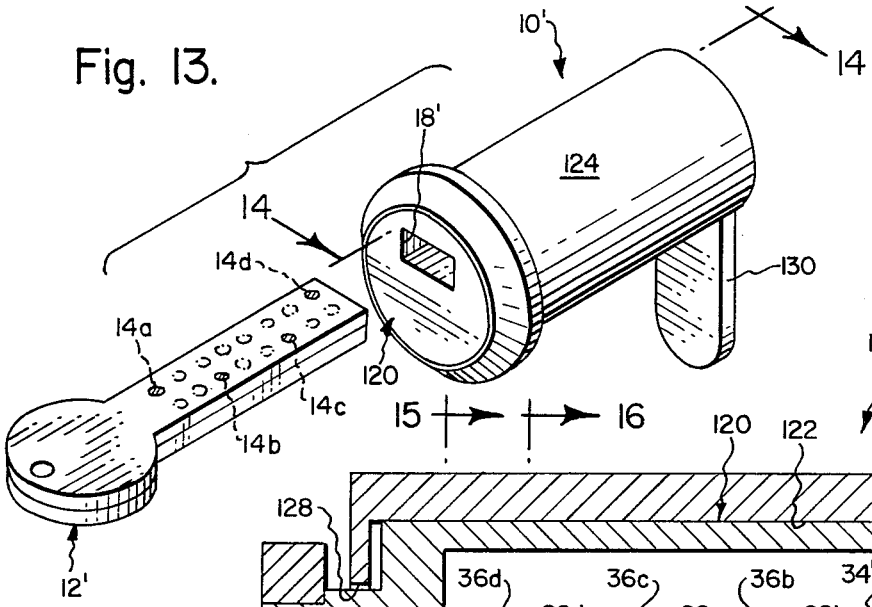
Fig. 14.
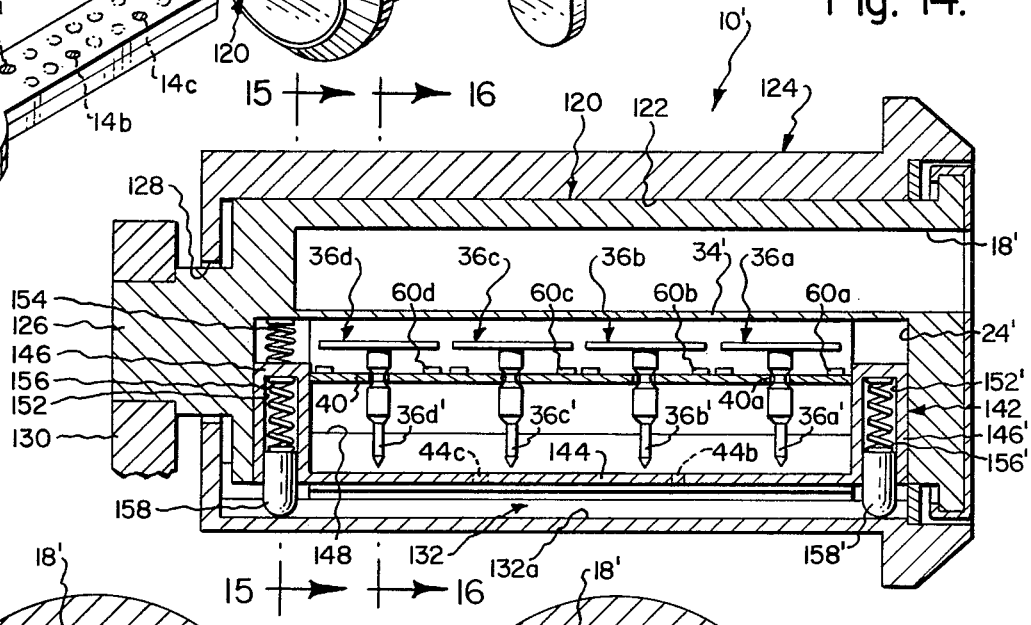
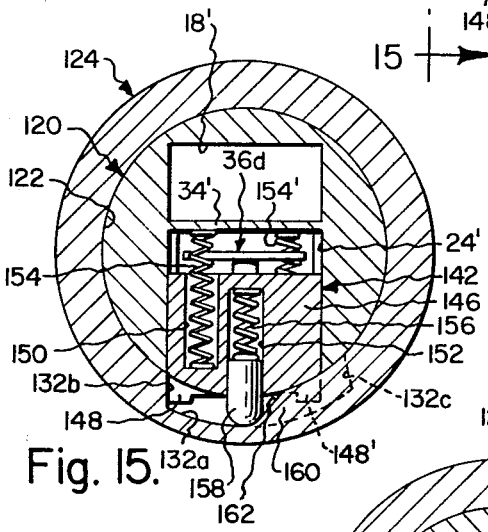
Fig. 15.
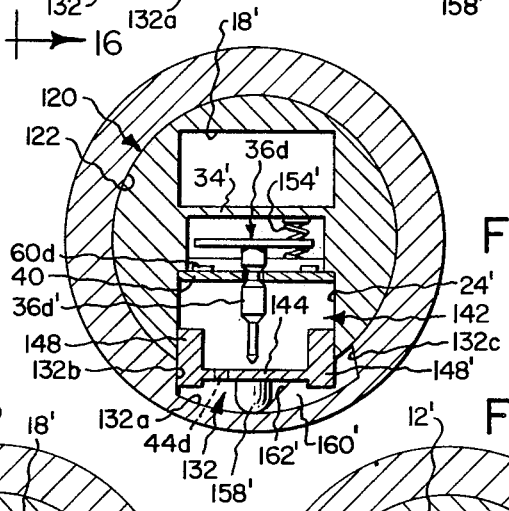
Fig. 16.
Fig. 17.
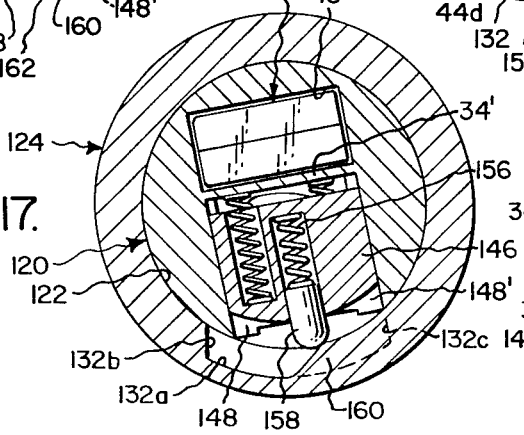
Fig. 18.
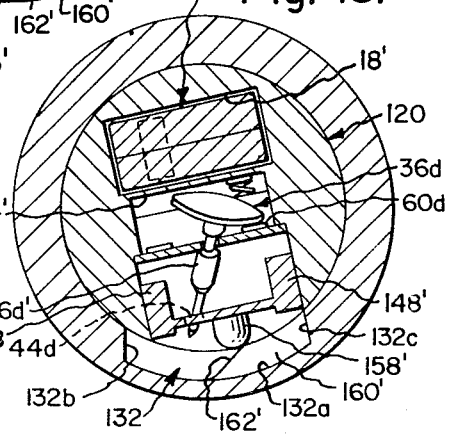

MAGNETIC LOCK

BACKGROUND OF THE INVENTION

Magnetic locks, which employ tumbler pins supported intermediate their ends for pivotal movement and a locking plate having openings arranged to receive adjacently disposed ends of such tumbler pins when opposite ends thereof are attracted by permanent magnet devices carried by a key, are presently well known in the patent art, as evidenced by U.S. Pat. Nos. 428,247; 3,056,276; 3,657,907 and 3,857,262.

In these prior constructions, when the tumbler pins are attracted they automatically align themselves with both their attracting magnet device and the respective openings of the locking plate into which their ends are to be inserted. Manufacturing considerations dictate that the number of well defined possible combination setting positions of each tumbler pin be determined by the possible number of locking plate openings, which can be accommodated without substantial overlapping along a circular path whose center is aligned with the point about which the tumbler pin pivots. Thus, with this arrangement, when it is desired to increase the possible number of combination setting positions of the tumbler pin, it is necessary to increase theh radius of the circular path. A drawback of this construction is that as the radius increases, the magnetically attracted end of the tumbler pin must swing further and further away from the key in which its associated magnet device is imbedded with the result that the tumbler pin is less and less influenced by the magnetic field established by such magnet device. For any given construction, this sets a definite limit on the possible number of well defined combination setting positions of the tumbler pin. Moreover, with this construction, the tumbler pin is subject to vibration induced misalignments with respect to its associated opening of the locking plate, particularly under weak magnetic field conditions.

SUMMARY OF THE INVENTION

The present invention is directed towards an improvement in magnetic locks of the type employing pivotally supported magnetically attracted tumbler pins whose ends are adapted to be received within openings of a locking plate when the tumbler pins assume their respective combination setting positions.

The present invention is primarily directed towards a magnetic lock employing a tumbler pin having an enlarged head end portion, which when placed within the magnetic field of an associated key-carried permanent magnet device tends to move towards the key and thus into a position of maximum magnetic field strength. Moreover, the tumbler pin mounting member is preferably formed with abutment devices in the form of wedges, which are arranged to engage with the head end portion of the tumbler pin in order to provide in cooperation with the pivot bearing of the tumbler pin a three-point suspension for the tumbler pin when in its combination setting position, such that it accurately "points" towards its associated locking plate opening. These features combine to assure maintenance of proper alignment of the tumbler pins with their associated locking plate openings even when the lock is subjected to substantial vibration and/or tilting movements.

The present invention is also directed towards refinements in conventional pivotal tumbler pin-locking plate constructions including the provision of differently weighted tumbler pins and projecting rims bounding the locking plate openings to order to render the lock virtually impossible to pick; the provision of adjustable locking plates, which permit a magnetic lock to have its combination changed whenever its key has become lost or stolen; the provision of "soft" magnetizable elements arranged within the wall of the lock casing intermediate the tumbler pins and the magnet device of the key in order to permit the thickness of such wall to be substantially increased for security purposes; and a modification of the locking plate permitting utilization of pivotally supported tumbler pins in a cylinder type lock. These features possess utility in magnetic locks employing tumbler pins of conventional construction, as well as those formed in accordance with the preferred form of the present invention.

DRAWINGS

The nature and mode of operation of the present invention will now be more fully described in the following detailed description taken with the accompanying drawings wherein:

FIG. 1 is a perspective view of a padlock incorporating the present invention and a magnetic key employed to effect operation of the padlock;

FIG. 2 is an enlarged view of the key shown in FIG. 1;

FIG. 3 is an enlarged scale sectional view taken generally along the line 3—3 in FIG. 1;

FIG. 4 is a sectional view taken generally along the line 4—4 in FIG. 3;

FIGS. 5 and 6 are fragmentary sectional views similar to FIG. 3, but showing the lock in various stages of operation;

FIG. 7 is a view similar to FIG. 2, but showing an alternative arrangement of magnet devices within the key;

FIG. 8 is a fragmentary, sectional view similar to FIG. 3, but showing modifications of the present invention;

FIG. 9 is a sectional view taken generally along the line 9—9 in FIG. 8;

FIG. 10 is a fragmentary view taken generally along line 10—10 in FIG. 8;

FIG. 11 is an enlarged sectional view similar to FIGS. 3 and 8, but showing a further modified form of the present invention;

FIG. 12 is a sectional view taken generally along the line 12—12 in FIG. 11;

FIG. 13 is a perspective view of a cylinder type lock incorporating the present invention and a magnetic key for use therewith;

FIG. 14 is a sectional view taken generally along the line 14—14 in FIG. 13;

FIG. 15 is a sectional view taken generally along line 15—15 in FIG. 14;

FIG. 16 is a sectional view taken generally along line 16—16 in FIG. 14;

FIG. 17 is a sectional view similar to FIG. 15, but showing the lock in an unlocked condition; and FIG. 18 is a sectional view similar to FIG. 16, but showing the lock in an unlocked condition.

DETAILED DESCRIPTION

Reference is now made particularly to FIGS. 1–3, wherein a padlock incorporating the present invention is generally designated as 10 and shown in combination with a key 12 having a plurality of permanent magnet devices 14*a*–14*b* imbedded therewithin. Padlock 10 is conventional from the standpoint that it includes a lock casing or housing 16 having a recess 18 shaped and sized to positionally receive key 12, and a shackle or hasp 20. Shackle 20, which is normally of a generally J-shaped configuration, is formed with a main leg portion 20*a*, which extends through lock casing opening 22*a* and is normally permanently secured within the casing for both rotational and limited axial reciprocating movements between locked and unlocked positions, and a minor leg portion 20*b*, which is adapted to be removably locked within a blind recess or bore opening 22*b* of the lock casing.

Lock casing 16 is also shown as being formed with an internal cavity 24, which is arranged in communication with opening 22*a*. A magnetically controlled shackle locking-unlocking mechanism 30 is shown as being arranged within cavity 24 together with a suitable coupling device, such as bolt 32, which serves to operably interconnect mechanism 30 and shackle leg portion 20*a* or, if desired, leg portion 20*b*. Mechanism 30 is disposed in operative alignment with recess 18 and separated therefrom by a relatively thin partition wall 34 formed of a nonmagnetic material in order to prevent interference with the proper operation of mechanism 30 by magnet devices 14*a*–14*d* when key 12 is inserted within recess 18.

Mechanism 30 comprises at least one and preferably a plurality of tumbler pins 36*a*–36*d*, which are supported on a stationary mounting member or plate 40 by suitable bearing means for pivotal or tilting movements; and a locking member or plate 42, which is formed with a plurality of openings 44*a*–44*d* arranged to open through plate face or surface 42′ and be associated one with each of tumbler pins 36*a*–36*d*. Locking plate 42 is guided or constrained for reciprocating movements in a direction normal to plate 40 between the divergent locking and convergent unlocking positions thereof shown in FIGS. 5 and 6, respectively. Guiding of plate 42 may be achieved in any desired manner, but for purposes of reference, plate 42 is shown as being formed with a projecting guide pin 46, which is slidably received within sleeve portion 48 fixed to extend inwardly from partition wall 34, and a guide opening 50, which serves to slidably receive a lock casing mounted guide pin 52. Locking plate 42 is normally biased towards its unlocked position by suitable means, such as a coil spring 54.

Locking plate 42 may be operably connected or coupled with bolt 32 in any suitable manner, such as by providing the locking plate with a rearwardly projecting operating pin or member 56 arranged to end engage with a cam or drive surface 58 defined by bolt 32. It will be understood that the specific construction of bolt 32 and the manner in which it is operably interconnected with shackle leg portion 20*a* forms no part of the present invention. Alternatively, a direct coupling arrangement may be employed to interconnect locking plate 42 and shackle leg portion 20*a*, such as for instance that illustrated in either of U.S. Pat. Nos. 3,657,907 or 3,857,262.

Tumbler pins 36*a*–36*d* may be considered as having locking end, intermediate or mounting, and magnetically attractable end portions designated as 36*a*′–36*d*′; 36*a*″–36*d*″ and 36*a*‴–36*d*‴, respectively. Preferably, intermediate portions 36*a*″–36*d*″ would be formed with annular grooves, which cooperate with apertures 40*a*–40*d* formed in mounting plate 40, to define the above mentioned bearing means. However, any other suitable means may be employed to support the tumbler pins such that the free ends of locking end portions 36*a*′–36*d*′ may be moved into "combination setting" positions in alignment with their associated locking plate openings 44*a*–44*d* under the control of magnet devices 14*a*–14*d*, when locking plate 42 is in its locked position.

Convenience in manufacturing the locking plate 42 and key 12 on a commercial scale dictates that locking plate openings 44*a*–44*d* be arranged to lie at combination setting positions disposed along circular paths when centers are aligned with their associated mounting plate openings 40*a*–40*d*. Thus, the free ends of locking end portions 36*a*′–36*d*′ are considered as being free to move along circular paths of travel into combination setting positions aligned with their associated locking plate openings 44*a*–44*d*. It is not intended, however, that the expression "circular path of travel" be considered as requiring the free ends of the locking end portions to be constrained for movement only along a circular path, since as will be apparent from viewing FIG. 5, these free ends can move to assume any position within a circle whose center is aligned with mounting plate bearing openings 40*a*–40*d*, whenever locking plate 42 assumes a locked position whose distance from mounting plate 40 exceeds the length of that portion of the tumbler pins projecting through the mounting plate towards the locking plate. Thus, for this case it would be possible to arrange individual ones of the locking plate openings at any point within the circular area traversed by the locking end portions of the tumbler pins, as for instance at a point aligned with the bearing openings of the mounting plate. On the other hand, it will be understood that the tumbler pins may in fact be constrained for movement essentially along a circular path of travel, that is, within an annular band by decreasing the effective distance between the mounting plate and the locking plate, when the latter is in its divergent locking position. In any event, the orientation of the locking plate openings relative to their associated tumbler pins will determine the required placement of the magnet devices within key 12.

In the illustrated example of the present lock construction, mechanism 30 employs four tumbler pins and thereby requires four magnet devices to be imbedded within separate areas of key 12. The magnet devices, tumbler pins and locking plate openings are shown as being arranged and sized to permit each tumbler pin to assume eight distinct and equally spaced possible combination setting positions including a given combination setting position in which its locking end portion is aligned with its associated locking plate opening. Of course, as indicated in FIG. 4, the tumbler pins would preferably be provided with combination setting positions, which differ from one another, in order to render the lock more difficult to pick and to prevent random tilting movements of mechanism 30 from simultaneously placing all of the tumbler pins in alignment with their associated locking plate openings.

Operation of lock 10, as thus far described, is conventional from the standpoint that movements of an operator, such as shackle unlocking rotation of bolt 32 in a clockwise direction (as viewed in FIGS. 3, 5 and 6), is employed to drive locking plate 42 against the return bias of spring 54 from its locked position shown in FIG. 5 towards its unlocked position shown in FIG. 6. Convergent unlocking movement of locking plate 42 is prevented by engagement of locking face 42' with the adjacently disposed or free ends of locking end portions 36a'–36d' of tumbler pins 36a–36d, when the latter are not arranged in their respective predetermined, "combination setting" positions, as indicated in FIG. 3, but is permitted after locking end portions 36a'–36d' have been aligned with their associated locking plate openings 44a–44d by means of a proper key inserted within recess 18, as indicated in FIGS. 5 and 6. When locking plate 42 is disposed in its unlocked position, shackle 20 or other locking element of the lock is freed for movement into its unlocked position. Upon removal of key 12 and rotation of bolt 32 in a counterclockwise direction into its normal locked condition, spring 54 serves to return locking plate 42 to the position shown in FIG. 5, whereupon tumbler pins 36a–36d are freed to assume some non-combination setting or locking position determined by gravity or other suitable bias acting thereon.

The construction illustrated in FIGS. 1–6 departs from prior constructions of which I am aware in several respects, including the plan view arrangement of the tumbler pins 36a–36d relative to mounting plate 40, ie. the location of mounting plate openings 40a–40d; the construction of the tumbler pins featuring the provision of transversely enlarged, generally disc shaped end portions 36a'''–36d'''; and the provision of generally wedge-shaped abutment devices 60a–60d, which are preferably formed integrally with mounting plate 40.

More specifically, it will be seen by reference to FIG. 4 that mounting plate bearing openings 40a–40d are arranged to lie at the juncture of radial lines I–IV with a circular path X whose center is coincident with the axis of guide pin 46; there being an angle of approximately 72° between lines I–II, II–III and III–IV, and an angle of approximately 144° between the lines IV–I. This arrangement is preferred for the reason that four magnet device location areas may be conveniently located within the illustrated, generally U-shaped configuration of key 12, as indicated in FIG. 2. By referring to FIG. 2, it will be understood that these magnet device location areas also lie at the junctures of radial lines I–IV with circular path X, and are thus centered or aligned with mounting plate bearing openings 40a–40d when key 12 is inserted into recess 18. Alternatively, if a key having a generally rectangular configuration were to be employed, the tumbler pins could be arranged in one or more rows, as will be more clearly described with reference to FIGS. 13–18.

The provision of enlarged end portions 36a'''–36d''' on the tumbler pins is particularly advantageous in that it permits the magnetically attracted ends of the tumbler pins to actually move towards key 12 and into a position of maximum field strength as they pivot or tilt to assume their combination setting positions under the control of the magnet devices 14a–14d. This is to be distinguished from conventional constructions, wherein the magnetically attractable ends of the tumbler pins move away from the key as the tumbler pins tilt to assume their combination setting positions. It will also be noted that the present construction results in the placement of the magnet devices within key 12, such that they are disposed in essential alignment with the locking plate openings 44a–44d and are bisected by a common plate extending radially of guide pin 46. Moreover, the weight of end portions 36a'''–36d''' serve to unbalance the tumbler pins, whereby to easily overcome any frictional force within the tumbler pin bearing means, which might otherwise tend to oppose movement of the tumbler pins away from their "combination setting" positions when locking plate 42 is returned to its fully unlocked position shown in FIG. 5.

In the preferred form of the present invention, end portions 36a'''–36d''' are in the form of discs coaxially aligned with their associated locking and intermediate portions 36a'–36d' and 36a''–36d'', respectively.

Again making reference to FIGS. 3–6, it will be seen that abutment devices 60a–60d are equally spaced apart around a circular path whose center is coincident with their associated mounting plate openings 40a–40d and arranged to lie intermediate or alternately with the "possible combination setting" positions of their associated locking plate openings 44a–44d. The arrangement is such that when tumbler pins 36a–36d are attracted by magnet devices 14a–14d to assume their "combination setting" positions, the rims of end portions 36a'''–36d''' engage with a pair of their associated abutment devices 60a–60d, which are arranged diametrically opposite to the "combination setting" positions of their associated locking plate openings 44a–44d. Thus, engaged pairs of abutment devices cooperate with the bearing means to provide a three-point suspension or support for each of their associated tumbler pins, which insures that locking end portions 36a'–36d' accurately "point" towards locking plate openings 44a–44d, as best shown in FIG. 5. This mode of supporting the tumbler pins serves to positively prevent movement of locking end portions 36a'–36d' along their circular paths of travel away from their "combination setting" positions even when the lock is subjected to substantial vibration or tilting movements. While the illustrated construction is preferred, it would of course be possible to support the tumbler pins at more than three points, as by replacing the wedge shaped abutment devices by a plurality of concave recesses formed in the surface of mounting plate 40. Also, the provision of abutment devices would be advantageous for use in association with conventional "straight" tumbler pins.

FIGS. 7–10 illustrate several alternative forms of the invention, which depart from that discussed above principally in that means are provided to change the "combination" of the lock; to render the tumbler pins more difficult to manipulate or pick; and to increase the overall security of the lock, as afforded by casing 16.

The construction illustrated in FIGS. 8 and 9 permits the lock "combination" to be changed by supporting locking plate 42 for adjustable stepwise rotation about the axis of guide pin 46 under the control of a custodian's tool, not shown, which is removably engageable as by way of example, with a lug 46a formed on the free end of guide pin 46. Access to lug 46a may be normally prevented by any suitable means, such as a threaded casing plug 70. Alternatively, a section 16a of lock casing 16 may be made removable to afford custodian tool access to lug 56a formed on the free end of operating pin 56. This latter arrangement would be particularly adapted for use in changing the combination of magnetic door locks. More specifically, locking plate guide pins 52 are mounted on a guide plate 72, which is in turn positionally supported within a stationary, cup-shaped holder 74 whose rim is fixed to mounting plate 40. The proximity of guide plate 72 to base wall 74a of holder 74 and the free ends of guide pins 52 to mounting plate 40, serves to constrain the guide plate from reciprocating movements, while permitting rotation thereof relative to base wall 74*a*. In the illustrated construction, guide plate 72 and thus locking plate 42 may be releasably locked in one of five combination change positions by any suitable means, such as ball detents 76, which are releasably maintained to partially project into guide plate apertures 78 by spring plates 80 fixed to base wall 74*a*.

By viewing FIGS. 8 and 9, it will be understood that locking plate 42 departs from that previously described in that it is formed with five tumbler pin receiving openings 40*a*–40*e;* such openings being arranged within five distinct areas spaced equally apart around circular path X whose center is coincident with the axis of guide pin 46. Openings 40*a*–40*d* are shown in FIG. 9 as being arranged to receive the locking end portions of tumbler pins 36*a*–36*d*, whenever a key having the specific arrangement of magnet devices 14*a*–14*d* shown in FIG. 7 is applied. When the key shown in FIG. 7 becomes lost or stolen and it is therefore desired to change the lock combination, it is merely necessary to rotate locking plate 42 into a new combination position by the application of a custodian tool to lugs 46*a* or 56*a;* spring plates 80 deforming sufficiently to allow ball detents 76 to ride out of apertures 78 during driven rotations of the locking plate. As by way of example, if locking plate 42 is rotated in a clockwise sense, as viewed in FIG. 9, through 72° into its next "combination" position, opening 40*e* will be placed in operative association with tumbler pin 36*a*, whereas openings 40*a*–40*c* will be moved into association with tumbler pins 36*b*–36*d*, respectively. Thus, the lock construction shown in FIGS. 8 and 9 may be adjusted in a stepwise manner to provide five different combinations each of which require that a different key be employed to operate the lock.

Again referring to FIG. 8, it will be understood that the illustrated construction also renders the tumbler pins more difficult to manipulate or pick by forming each of openings 44*a*–44*e* with an annular rim 90, which upstands from locking plate face 42′; and/or by non-uniformly weighing the tumbler pins, such that the tumbler pins tend to assume differing orientations within the lock in the absence of key 12.

The non-uniform weighing of the tumbler pins is illustrated in FIG. 8 in the case of tumbler pins 36*a* and 36*d*, wherein the latter is of a construction identical to that shown in FIG. 3, but the former is provided with an enlargement 92 arranged intermediate tumbler pin portions 36*a′* and 36*a″*. The weight of enlargement 92 or its distance from the bearing of tumbler pin 36 may be selected to entirely overcome the weight of disc shaped end portion 36*a‴*, as indicated in FIG. 8, or may be chosen to exactly balance the latter such that the axis of tumbler pin 36*a* is normally arranged perpendicular to locking plate surface 42′. In any event, the differential weighting of the tumbler pins employed in the lock construction insures that their locking end portions do not point in the same direction for any given orientation of the lock and this prevents unauthorized manipulation of the tumbler pins relative to a common reference position or orientation.

Rims 90, which are preferably formed incident to punch forming of openings 40*a*–40*e*, serve to prevent alignment of tumbler pin locking end portions 36*a′*–36*d′* with the locking plate openings when the former are moved along their circular paths of travel, while in or substantially in engagement with locking plate surface 42′, incident to an attempt to pick the lock by manipulating bolt 32 while rotating a magnet device along a circular path adjacent the disc shaped end portion of one of the tumbler pins.

Now referring to FIGS. 8 and 10, it will be understood that the overall security of the lock, as afforded by casing 16, may be substantially increased by increasing the thickness of partition wall 34, as measured between its recess and cavity bounding walls, to an extent sufficient to prevent access to cavity 24 unless a drill or steel punch and hammer are employed. A partition wall of this thickness may normally not be employed in a magnetically operated lock for the reason that tumbler pins would be spaced from the relatively small magnet devices of the key through a distance, which would significantly diminish the magnetic force acting on the tumbler pins, so as to render the magnet devices ineffectual as to proper positioning of the tumbler pins. In accordance with this form of the present invention, a relatively thick partition wall may be employed without adversely effecting magnetic attraction of the tumbler pins by means of permanently imbedding a plurality of cylinder elements 94*a*–94*d* formed of a suitable "soft" magnetic material within partition wall 34, such that their outer ends are hidden, but arranged closely adjacent the outer surface of the partition wall, and one of such elements is arranged in essential end to end alignment with each of the magnet devices 14*a*–14*d* when the key is applied to the lock. By soft is meant a material capable of "conducting" or defining a path for magnetic lines of force, while being unable to effectively attract the tumbler pins when key 12 is removed from recess 18. Thus, when key 12 is applied, the elements 94*a*–94*d* tend to pick up their associated tumbler pins, that is, magnetically couple the tumbler pins with the magnet devices, much in the same manner as a paper clip under the influence of a strong magnet would tend to pick up an adjacent paper clip to form an end connected string of paper clips. For an adjustable combination lock of the type illustrated in FIGS. 8 and 9 or to be discussed with reference to FIGS. 11 and 12, one of these elements would be arranged in alignment with each of the possible combination setting positions of each of the magnet devices 14*a*–14*d;* it having been found that the relative proximity of adjacent, but non-contacting adjacent elements does not interfere with proper attraction of the tumbler pins. As will be apparent, for locks not having a combination change capability, such as that illustrated in FIG. 3, it would be only necessary to employ one of these elements arranged for alignment with each of magnet devices 14*a*–14*d*. However, even in this latter case, it would be preferable to provide a full complement of elements, that is, one arranged for alignment with each of the possible combination setting positions of each of the magnet devices, in order to both simplify manufacturing procedures and to prevent an unauthorized person from obtaining knowledge of the combination of the lock by the simple expedient of scraping or cutting away portions of the outer surface of petition wall 34 in order to expose the outer ends of such elements.

Reference is now made particularly to FIGS. 11 and 12, which illustrate an alternative construction for providing a lock with combination change capabilities. This construction is similar to that illustrated in FIG. 8 from the standpoint that locking plate 42 is arranged intermediate base wall 74*a* of cup-shaped member 74 and mounting plate 40. However, in this construction guide pins 52 are rigidly fixed to base wall 74*a*, whereby to constrain the locking plate from relative rotational movement. Adjustment of the lock combination is achieved by forming locking plate openings 44*a*–44*d* within one or more locking disc members 100*a*–100*d*, which are supported within locking plate cavities 102*a*–102*d* for rotation about axes extending essentially through the bearings of their associated tumbler pins 36*a*–36*d* and parallel to the axis of guide pin 46.

In the arrangement shown in FIGS. 11 and 12, locking disc members 100*a*–100*d* may be releasably retained in eight possible combination setting positions by means of a latch plate 104, which is supported on locking plate 42 for reciprocating movement axially of guide pin 46 by means of locking plate mounted guide pins 106 received within latch plate apertures 108. Latch plate 104 carries detents or latch leg portions 110, which are removably biased by operation of spring 54 into latch-recesses 112*a*–112*d* of locking disc members 100*a*–100*d* in order to normally lock the locking disc members against rotation relative to locking plate 42. Stepwise rotations of locking disc members 100*a*–100*d* between their "possible combination setting" positions established by engagement of leg portions 110 within successive ones of recesses 112*a*–112*d* may be individually effected by means of a custodian's tool, not shown, which may be removably insertable into like configured, blind recesses 114*a*–114*d*, which are arranged centrally within the locking disc members in alignment with a plurality of access apertures 116 formed in base wall 74*a*. Preferably, recesses 114*a*–114*d* would be shaped as "arrow heads" arranged to "point" towards openings 44*a*–44*d* in order to provide the custodian with a visual indication of the combination setting of each of the disc members. As in the case of the alternative access arrangement illustrated in FIG. 8, access to cavity 24 for the purpose of individually adjusting locking disc members 100*a*–100*d* may be afforded by removable casing part 16*a*.

Reference is now made to FIGS. 13–18, wherein the features of the present invention are shown, as by way of further example, as being incorporated within a cylinder type lock 10′. More specifically, tumbler pins 36*a*–36*d* are shown as being pivotally supported on a mounting plate 40 in the same manner as previously described with reference to FIGS. 1–12, except that the tumbler pins are arranged in a row and disposed within a cavity 24′ of a generally cylindrical lock plug 120.

Plug 120 is supported for rotation about its axis within a cylindrical bore opening 122 of a stationary, generally tubular casing 124 and formed with a drive projection or stud 126, which extends rearwardly through an opening 128 formed in casing 124 and is keyed or otherwise suitably connected to a latch device 130. Further, plug 120 is formed with a lengthwise extending, front opening slot or recess 18′, which is separated from plug cavity 24′ by a partition wall 34′ and serves to positionally locate key 12′, and thus its magnet devices 14*a*–14*d*, relative to the tumbler pins.

In the present construction, cavity 24′ is in the form of an elongated, generally rectangular recess, which opens radially of plug 120. When the lock is in its locked condition shown in FIGS. 13–16, cavity 24′ is disposed in essential radial alignment with a similarly configured recess 132, which is formed in casing 124 and opens radially inwardly through bore 122. For purposes of reference, recess 132 may be considered as having a radially outer or base wall 132*a* and generally radially extending end stop or abutment walls 132*b*, 132*c*. Also, in this lock construction, the movable locking member is in the form of an elongated tumbler bar 142, which is supported by the generally radially extending walls of cavity 24′ for radially directed reciprocating movements between an unlocked position, wherein it is wholly received within cavity 24′, as shown in FIGS. 17 and 18, and a locked condition, wherein it extends across the cylindrically shaped shear line of the lock to project from cavity 24′ into recess 132.

Tumbler bar 142 comprises a central plate portion 144 in which are positioned locking plate openings 44*a*–44*d* for receiving locking end portions 36*a′*–36*d′* of the tumbler pins, when the proper key 12′ is inserted within recess 18′; like configured end portions 146, 146′; and a pair of parallel guide-locking flanges 148, 148′, which extend along lengthwise disposed opposite edges of plate portion 144 intermediate end portions 146, 146′ and cooperate with plate portion 144 to provide a high strength I beam construction. Each of end portions 146, 146′ has a generally cylindrical, radially outer surface and is formed with a pair of radially directed, but oppositely opening, blind end bore openings 150 and 152. Bore openings 150 are arranged to face radially inwardly of plug 120 towards partition wall 34′ and receive first spring devices 154, 154′, whereas bore openings 152 are arranged to face radially outwardly of plug 120 and receive second spring devices 156, 156′ and lock operating plungers 158, 158′. At this point, it will be understood that first spring devices 154, 154′ are of relatively light weight design or exert a relatively weak spring force, but are always maintained in a compressed state, such that they tend to exert a continuous bias for normally maintaining plate portion 144 in a spaced relationship relative to the locking end portions 36*a′*–36*d′* of the tumbler pins, when the lock is in its locked condition as shown in FIGS. 14–16. On the other hand, second spring devices 156, 156′ are of relatively heavy weight design or exert a relatively strong spring force as compared to the first spring devices, but are normally in an essentially relaxed or non-compressed state when the lock is in its locked condition. Thus, by reference to FIGS. 15 and 16, it will be understood that when lock 10′ is in its locked condition first spring devices 154, 154′ normally serve to maintain locking flanges 148, 148′ fully seated within casing recess 132 in engagement with base wall 132*a* and in a facing relationship with abutment walls 132*b* and 132*c*, respectively; plungers 158, 158′ also having their outer ends fully seated within recess 132, but not serving to compress second spring devices 156, 156′.

By again referring specifically to FIGS. 15 and 16, it will be understood that the opposite ends of casing recess 132 are provided with inserts 160, 160′, which serve to define inclined camming surfaces 162, 162′ arranged for engagement with the radially outer ends of plungers 158, 158′, respectively upon initiation of rotation of plug 120 in a counterclockwise direction towards its unlocking position. In this connection it will be noted that clockwise rotation of plug 20 away from its locked position is prevented by engagement of flange 148 with recess abutment wall 132*b*.

Lock 10′ may be operated by simply inserting the appropriate key 12′ into recess 18′, whereby to cause tumbler pins 36*a*–36*d* to assume their proper combination setting positions, wherein locking end portions 36*a*′–36*d*′ are aligned with their associated openings 44*a*–44*d* in plate portion 144, as indicated in the case of tumbler pin 36*d* in FIG. 18. Thereafter, plug 120 may be rotated from its locked into its fully unlocked position, not shown, by manual manipulation of key 12′. Incident to this unlocking rotation of plug 120, which would be in a counter clockwise direction as viewed in FIGS. 15–18, plungers 158, 158′ are caused to ride up on cam surfaces 162, 162′ in order to effect progressive compression of second spring devices 156, 156′; the tendency of second spring devices 156, 156′ to resist compression serving to move tumbler bar 142 radially inwardly of plug 120 against the return bias of first spring devices 154, 154′. In that the tumbler pins have been previously placed in their combination setting positions by the insertion of a proper key 12′ within recess 18′, tumbler bar 142 is freed for movement into its unlocked position shown in FIGS. 17 and 18, wherein it lies wholely within cavity 24′, and thus, flange 148′ is removed from facing or locking relationship with casing recess abutment wall 132*c*. This frees plug 120 for rotation into its fully unlocked position, which would normally be spaced through approximately 90° to 180° from its fully locked position. The elements of lock 10′ will automatically assume their positions illustrated in FIGS. 15 and 16 upon return of plug 120 to its unlocked position and removal of key 12′.

If an improper key or lock jimmying tool is inserted into recess 18′, one or more of tumbler pins 36*a*–36*d* will normally remain in some position other than their proper combination setting position. Thus, when an attempt is made to rotate plug 120, the locking end portions of those tumbler pins, which are not in their proper combination setting positions will engage with plate portion 144 and prevent radially directed inward movement thereof through a distance sufficient to remove flange 148′ from its facing or locking relationship with recess abutment wall 132*c*. Engagement of flange 148′ with recess abutment wall 132*c* will of course prevent continued rotation of plug 120 towards its unlocking position.

It will be particularly noted that those tumbler pins, which are arranged in locking or abutting engagement with plate portion 144, are not subjected to a high stress condition, since the only force acting thereon during an unauthorized attempt to unlock lock 10′ will be equal to the difference in the spring forces exerted by spring devices 154 and 156. This force is entirely independent of any force, which may be exerted on plug 120 by an authorized operator and need only be sufficient to overcome frictional forces acting on tumbler bar 142. On the other hand, the force exerted by an unauthorized operator is resisted by tumbler bar 142 and more particularly by flange 148′, which extends across the shear line for engagement with recess abutment wall 132*c* throughout substantially the whole length of casing 124. In effect, the present lock cylinder construction provides a multiple combination magnetic lock having only a single, but massivly sized tumbler serving to prevent unauthorized unlocking rotations of lock plug 120. This is of course to be distinguished from conventional magnetically operated cylindrical type locks, which typically employ a plurality of relatively weak, magnetically attractable tumbler pins arranged to extend across the shear line of the lock.

I claim:

1. A magnetic lock comprising in combination:

a pair of members mounted for movement between a divergent locking position and converging unlocking position;

a tumbler pin having a locking end portion and an opposite end portion including a magnetically attractable transversely enlarged portion;

bearing means for pivotally supporting said tumbler pin intermediate said end portions thereof on one of said members to assume a plurality of positions wherein said locking end portion points toward the other of said members, said other of said members having an opening arranged to receive said locking end portion of said tumbler pin and thereby permit converging unlocking movement of said members when said tumbler pin assumes a predetermined position relative to said one member; and a magnetic key having a magnet device adapted to be positioned in essential alignment with said opening in the direction of movement of said members for attracting said enlarged portion and causing said tumbler pin to assume said predetermined position.

2. A magnetic lock according to claim 1, wherein the weight of a first portion of said tumbler pin extending from said bearing means towards and including said locking end portion is less than the weight of a second portion of said tumbler pin extending from said bearing means towards and including said transversely enlarged portion.

3. A magnetic lock according to claim 1, wherein the weight of a first portion of said tumbler pin extending from said bearing means towards and including said locking end portion is at least equal to the weight of a second portion of said tumbler pin extending from said bearing means towards and including said transversely enlarged portion.

4. A magnetic lock according to claim 1, wherein said one of said members is formed with abutment means upstanding from a surface thereof facing towards said transversely enlarged portion, said abutment means being arranged for engagement by said transversely enlarged portion upon movement of said tumbler pin into said predetermined position, thereby to cooperate with said bearing means to provide a minimum three point support for said tumbler pin when in said predetermined position.

5. A magnetic lock according to claim 1, wherein at least that portion of said other of said members defining said opening is supported for stepwise adjustments about an axis extending co-directionally with the direction of movement of said members whereby to adjustably vary positioning of said opening relative to said bearing means.

6. A magnetic lock according to claim 1, wherein said one of said members is carried by the plug of a cylinder type lock additionally including a stationary casing in which said plug is received for rotation about its axis between locked and unlocked positions thereof, said casing having a recess opening generally radially towards said plug, said plug having an elongated slot extending in a direction axially thereof for removably receiving said key and a cavity opening generally radially towards said casing, said cavity being generally aligned with said recess when said plug is in said locked position and rotatably displaced therefrom when said plug is in said ulocked position, said other of said members being a locking tumbler slidably supported within said cavity for essentially radially directed reciprocating movements between an unlocking position thereof wherein it is wholly received within said cavity and a locking position thereof in which it is received within both said cavity and said recess.

7. A magnetic lock according to claim 6, wherein a first spring device bearing on said plug and said locking tumbler acts to continuously bias said locking tumbler towards said locking position thereof, and said locking tumbler carries a plunger and a second spring device, said plunger having a radially outer end removably insertable within said recess to assume a fully extended position, said second spring device being in an essentially non-compressed state when said outer end of said plunger is disposed in said fully extended position and being compressed upon movement of said outer end of said plunger out of said recess incident to rotation of said plug between locked and unlocked positions thereof, said second spring device being characterized as having a spring force in excess of the spring force of said first spring device whereby to effect movement of said locking tumbler towards said locking end portion of said tumbler pin against the bias of said first spring device incident to rotation of said plug from said locked position towards said unlocked position thereof, and said tumbler pin preventing movement of said locking tumbler wholly within said cavity unless said tumbler pin assumes said predetermined position.

8. A magnetic lock comprising in combination:

a pair of members mounted for movement between a divergent locking position and a convergent unlocking position;

a magnetically attractable tumbler pin;

bearing means for tiltably supporting said tumbler pin on one of said members so as to enable said tumbler pin to assume any one of a plurality of positions with one end thereof pointing towards the other of said members, said other of said members having an opening arranged to receive said one end and thereby permit movement of said members into said unlocking position only when said tumbler pin is in a predetermined position relative to said one of said members;

a key having a magnet device adapted to position said tumbler pin in said predetermined position; and abutment means positionally fixed relative to said one of said members and arranged in a spaced relationship to said bearing means, said abutment means being arranged for engagement by said tumbler pin when moved into said predetermined position, and cooperating with said bearing means to provide a minimum three point support for said tumbler pin when in said predetermined position.

9. A magnetic lock according to claim 8, wherein an end of said tumbler pin opposite to said one end is formed with a transversely enlarged disc-shaped head portion, said head portion being magnetically attractable by said magnet device to effect movement of said tumbler pin into said predetermined position and having a rim portion thereof engagable with said abutment means when said tumbler pin is in said predetermined position.

10. A magnetic lock according to claim 8, wherein said one of said members is carried by the plug of a cylinder type lock additionally including a stationary casing in which said plug is received for rotation about its axis between locked and unlocked positions thereof, said casing having a recess opening generally radially towards said plug, said plug having an elongated slot extending in a direction axially thereof for removably receiving said key and a cavity opening generally radially towards said casing, said other of said members being a locking tumbler slidably supported within said cavity for essentially radially directed reciprocating movements between an unlocking position thereof wherein it is wholly received within said cavity and a locking position thereof in which it is received within both said cavity and said recess.

11. A magnetic lock according to claim 10, wherein a first spring device bearing on said plug and said locking tumbler acts to continuously bias said locking tumbler towards said locking position thereof, and said locking tumbler carries a plunger and a second spring device, said plunger having a radially outer end removably insertable within said recess to assume a fully extended position, said second spring device being in an essentially non-compressed state when said outer end of said plunger is disposed in said fully extended position and being compressed upon movement of said outer end of said plunger out of said recess incident to rotation of said plug between locked and unlocked positions thereof, said second spring device being characterized as having a spring force in excess of the spring force of said first spring device whereby to effect movement of said locking tumbler towards said locking end portion of said tumbler pin against the bias of said first spring device incident to rotation of said plug from said locked position towards said unlocked position thereof, and said tumbler pin preventing movement of said locking tumbler wholly within said cavity unless said tumbler pin assumes said predetermined position.

12. A magnetic lock according to claim 9, wherein at least that portion of said other of said members defining said opening is supported for stepwise adjustments about an axis extending co-directionally with said direction of movement of said members whereby to adjustably vary positioning of said opening relative to said tumbler pin bearing means.

13. In a magnetically operable lock having a pair of members mounted for movement between a divergent locking position and a converging unlocking position, a magnetically attractable tumbler pin, bearing means for universally pivotally supporting said tumbler pin on one of said members to project therefrom towards the other of said members, one end of said tumbler pin projecting towards said other of said members being movable to assume any position along a circular path, said other of said members having an opening in a face thereof arranged adjacent said one of said members at a position in alignment with a predetermined position of said one end of said tumbler pin along said circular path, and a key having a magnet device adapted to position said tumbler pin with said one end in said predetermined position in alignment with said opening to permit convergent movement of said members, the improvement comprising in combination:

abutment means positionally fixed relatively to said one of said members and arranged in a spaced relationship to said bearing means, said abutment means being engageable with said tumbler pin when said one end of said tumbler pin is positioned in said predetermined position for constraining said one end from movement along said circular path away from said predetermined position.

14. An improvement according to claim 13, wherein an end of said tumbler pin opposite said one end is formed with a transversely enlarged disc portion, said disc portion being magnetically attractable by said magnet device to effect movement of said one end into said predetermined position and being engagable with said abutment means when said one end is moved into said predetermined position.

15. An improvement according to claim 14, wherein said abutment means comprises a plurality of wedges, a pair of said wedges being disposed essentially diametrically opposite to said opening of said other of said members along said circular path for engagement with spaced points of a rim portion of said disc portion when said one end is moved into said predetermined position.

16. The improvement according to claim 14, wherein the weight of a first portion of said tumbler pin extending from said bearing means towards and including said one end of said tumbler pin is less than the weight of a second portion of said tumbler pin extending from said bearing means towards and including said disc portion.

17. The improvement according to claim 14, wherein the weight of a first portion of said tumbler pin extending from said bearing means towards and including said one end of said tumbler pin is at least equal to the weight of a second portion of said tumbler pin extending from said bearing means towards and including said disc portion.

18. The improvement according to claim 13, wherein said other of said members is through punch formed to define said opening and an annular rim bounding said opening and upstanding from said face of said other of said members, said rim preventing said one end of said tumbler pin when engaged with said face of said other of said members from moving along said circular path into said opening.

19. A magnetic lock comprising in combination:

a casing defining a key positioning recess, an internal cavity and a partition wall of non-magnetizable material separating said recess from said cavity, said partition wall having spaced recess and cavity bounding surfaces;

mounting means positionally fixed within said cavity relatively adjacent said cavity bounding surface;

locking means arranged within said cavity relatively remote from said cavity bounding surface, said locking means being mounted for movement relative to said mounting means between a divergent locking position and a convergent unlocking position;

at least one magnetically attractable tumbler pin;

bearing means for tiltably supporting said tumbler pin on said mounting means so as to assume any one of a plurality of positions with one end thereof pointing towards said locking means, said locking means having an opening disposed for alignment with and adapted to receive said one end of said tumbler pin only when said tumbler pin assumes a predetermined position relative to said mounting means;

a magnetic key having a magnet device, said key being adapted to be positionally oriented within said recess to arrange said magnet device for attracting an opposite end of said tumbler pin to cause said tumbler pin to assume said predetermined position, thereby to permit movement of said locking means into said convergent unlocking position, said partition wall having a thickness measured between said recess and cavity bounding surfaces sufficient to space said magnet device from said tumbler pin through a distance significantly diminishing the magnetic force of said magnet device acting on said tumbler pin; and at least one element formed of "soft" magnetic material and arranged within said partition wall to extend essentially between said recess and cavity bounding surfaces, and said element being arranged for essential end to end alignment with said magnet device when said key is positionally oriented within said recess for magnetically "coupling" said tumbler pin with said magnet device.

20. A magnetic lock according to claim 19, wherein a plurality of said elements are provided and arranged at essentially equally spaced points along a circular path whose center is aligned with an axis passing through said bearing means in the direction of movement of said locking means, said opening of said locking means being spaced from said axis, and said opening of said locking means and one of said elements are bisected by a common plane extending radially of said axis.

21. A magnetic lock according to claim 20, wherein said one of said elements bisected by said plane is arranged in essential alignment with said opening of said locking means, said opposite end of said tumbler pin carries a transversely enlarged disc-shaped head portion, and said head portion is adapted to be magnetically "coupled" to said magnet device by said one of said elements.

22. A magnetic lock according to claim 21, wherein said locking means defines at least one additional opening, and said locking means is supported for lock combination changing rotation about an axis arranged parallel to said axis for removing said opening of said locking means from operative association with said one end of said tumbler pin and for positioning said additional opening in operative association with said one end of said tumbler pin, wherein said additional opening and another one of said elements are bisected by a common plane extending radially of said axis and arranged at an angle relative to the first said common plane.

23. A magnetic lock according to claim 20, wherein said locking means includes a combination changing locking disc, said locking disc defining said opening and being supported by said locking means for lock combination changing rotations about said axis whereby to position said opening for alignment with said one end of said tumbler pin when said tumbler pin is disposed in an other said predetermined position determined by the placement of said magnet device in essential alignment with an other of said plurality of elements.

24. A magnetic lock comprising in combination:

a lock casing defining a generally cylindrical bore opening;

a generally cylindrical lock plug supported within said bore opening for rotary movements between locked and unlocked positions thereof, said plug having a slot opening extending generally axially thereof for receipt of a magnetic key having at least one magnet device imbedded therein and a cavity separated from said slot by a partition wall and opening radially towards said casing, said casing having a recess opening radially towards said plug and arranged whereby said cavity is generally aligned with said recess when said plug is in said locked position thereof and rotatably displaced therefrom when said plug is in said unlocked position thereof; and a magnetically operated plug locking, unlocking mechanism comprising a mounting member fixedly positioned within said cavity adjacent said partition wall, a locking tumbler supported within said cavity for essentially radially directed movements between an unlocking position thereof wherein it is wholly received within said cavity and a locking position thereof in which it is received within both said cavity and said recess, and at least one tumbler pin having a magnetically attractable end portion and a locking end portion, said tumbler pin being mounted on said mounting member to assume any one of a plurality of positions wherein said locking end portion points towards said locking tumbler and said attractable end portion is disposed adjacent said partition wall, said locking tumbler having an opening disposed for alignment with said locking end portion when said tumbler pin is disposed in a predetermined one of said plurality of positions in which said tumbler pin is placed by said magnet device acting on said attractable end portion when said key is inserted within said slot, said locking end portion blocking movement of said locking tumbler into said unlocking position except when said tumbler pin is disposed in said predetermined one of said plurality of positions.

25. A magnetic lock according to claim 24, wherein a first spring device bearing on said plug and said locking tumbler acts to continuously bias said locking tumbler towards said locking position thereof, and said locking tumbler carries a plunger and a second spring device, said plunger having a radially outer end removably insertable within said recess to assume a fully extended position, said second spring device being in an essentially non-compressed state when said outer end of said plunger is disposed in said fully extended position and being compressed upon movement of said outer end of said plunger out of said recess incident to rotation of said plug between said locked and unlocked positions thereof, said second spring device being characterized as having a spring force in excess of the spring force of said first spring device whereby to effect movement of said locking tumbler towards said locking end portion of said tumbler pin against the bias of said first spring device incident to rotation of said plug from said locked position towards said unlocked position thereof, and said tumbler pin preventing movement of said locking tumbler to a position wholly within said cavity unless said tumbler pin assumes said predetermined one of said plurality of positions.

26. In a magnetically operable lock having a pair of members mounted for movement between a divergent locking position and a converging unlocking position, a magnetically attractable tumbler pin, bearing means for universally pivotally supporting said tumbler pin on one of said members to project therefrom towards the other of said members, one end of said tumbler pin projecting towards said other of said members being movable to assume any position along a generally circular path, said other of said members having an opening in a face thereof arranged adjacent said one of said members at a position in alignment with a predetermined position of said one end of said tumbler pin along said circular path, and a key having a magnet device adapted to position said tumbler pin with said one end in said predetermined position in alignment with said opening to permit converging movement of said members, the improvement comprising in combination:

said other of said members includes a combination changing locking disc, said locking disc defining said opening and being supported by said other of said members for lock combination changing rotations about an axis passing through the center of said circular path, whereby to position said opening for alignment with said one end of said tumbler pin when said tumbler pin is disposed in an other said predetermined position as determined by placement of said magnet device within said key.

27. A lock according to claim 26, wherein a plurality of tumbler pins are supported on said one of said members and a plurality of said combination change locking discs are supported by said other of said members one in association with each of said plurality of tumbler pins, and said other of said members additionally includes a member operable for releasably and simultaneously latching said locking discs against rotation relative to said other of said members.

28. In a magnetically operable lock having a pair of members mounted for movement between a divergent locking position and a converging locking position, a plurality of magnetically attractable tumbler pins, a plurality of bearing means for pivotally supporting said tumbler pins on one of said members each of said tumbler pins having one end projecting towards said other of said members and being movable to assume any position along a generally circular path, said other of said members having a plurality of openings in a face thereof arranged adjacent said one of said members and being associated one opening with each of said tumbler pins to assume a position in alignment with a predetermined position of said one end of its associated tumbler pin along said circular path, and a key having a plurality of magnet devices arranged for association one with each of said tumbler pins, each of said magnet devices being adapted to position its associated tumbler pin with its one end in said predetermined position in alignment with its associated opening to permit convergent movement of said members, the improvement comprising in combination:

said bearing means for said tumbler pins are spaced apart along an other circular path whose center is intersected by an axis extended co-directionally with the direction of movement of said members; and said other of said members is additionally supported for rotation about said axis in a stepwise manner to successively position each of said openings thereof successively in association with each of said tumbler pins.

29. A lock according to claim 28, wherein said openings are arranged within a given number of opening areas in excess of the number of said bearing means and said opening areas have an equal angular spacing between adjacent said opening areas.

30. A magnetic lock comprising in combination:

a pair of members mounted for movement between a divergent locking position and convergent unlocking position;

a tumbler pin having a locking end portion and an opposite magnetically attractable end portion;

bearing means for pivotally supporting said tumbler pin intermediate said end portions thereof on one of said members to assume a plurality of positions wherein said locking end portion points toward the other of said members, said other of said members having an opening arranged to receive said locking end portion of said tumbler pin and thereby permit converging unlocking movement of said members when said tumbler pin assumes a predetermined position relative to said one of said members; and a magnetic key having a magnet device adapted to attract said magnetically attractable end portion for causing said tumbler pin to assume said predetermined position, at least that portion of said other of said members defining said opening being supported for stepwise adjustments about an axis extending co-directionally with said movement of said members for adjustably varying positioning of said opening relative to said bearing means.

* * * * *